US007948401B2

(12) United States Patent
Wartofsky et al.

(10) Patent No.: US 7,948,401 B2
(45) Date of Patent: May 24, 2011

(54) EMERGENCY TRANSMISSION MONITORING AND REPORTING

(75) Inventors: David J. Wartofsky, Accokeek, MD (US); Gary B. Simon, Winchester, MA (US)

(73) Assignee: Potomac Aviation Technology Corp., Boston, MA (US)

( * ) Notice: Subject to any disclaimer, the term of this patent is extended or adjusted under 35 U.S.C. 154(b) by 210 days.

(21) Appl. No.: 11/624,311

(22) Filed: Jan. 18, 2007

(65) Prior Publication Data

US 2008/0174418 A1 Jul. 24, 2008

(51) Int. Cl.
*G08B 21/00* (2006.01)

(52) U.S. Cl. ..... 340/945; 340/963; 340/981

(58) Field of Classification Search ..... 340/945, 340/963, 981, 982, 983, 514, 961, 970; 455/404, 455/414, 404.1, 414.1; 701/3, 14, 301; 342/29, 342/385, 386

See application file for complete search history.

(56) References Cited

U.S. PATENT DOCUMENTS

| | | | | |
|---|---|---|---|---|
| 4,093,920 | A | 6/1978 | Kaiser | |
| 4,240,079 | A | 12/1980 | Zhilin | |
| 4,630,289 | A | 12/1986 | Wren | |
| 4,636,796 | A | 1/1987 | Imazeki | |
| 4,777,658 | A | 10/1988 | Wren | |
| 4,888,595 | A | 12/1989 | Friedman | |
| 5,351,194 | A | 9/1994 | Ross et al. | |
| 5,367,306 | A * | 11/1994 | Hollon et al. | 342/386 |
| 5,862,454 | A | 1/1999 | Simon et al. | |
| 5,900,838 | A * | 5/1999 | Khan et al. | 342/457 |
| 6,073,004 | A * | 6/2000 | Balachandran | 455/404.2 |
| 6,208,718 | B1 * | 3/2001 | Rosenthal | 379/93.35 |
| 6,252,544 | B1 * | 6/2001 | Hoffberg | 342/357.1 |
| 6,285,318 | B1 | 9/2001 | Schoen et al. | |
| 6,348,856 | B1 * | 2/2002 | Jones et al. | 340/10.1 |
| 6,552,669 | B2 | 4/2003 | Simon et al. | |
| RE38,925 | E | 12/2005 | Simon et al. | |
| 7,116,272 | B2 * | 10/2006 | Wolf et al. | 342/443 |
| 2002/0177428 | A1 * | 11/2002 | Menard et al. | 455/404 |

* cited by examiner

*Primary Examiner* — Anh V La
(74) *Attorney, Agent, or Firm* — Hamilton, Brook, Smith & Reynolds, P.C.

(57) ABSTRACT

A method, apparatus and system for monitoring an emergency frequency at a ground station for detection of an emergency signal and, upon detecting an emergency signal, determining whether the emergency signal represents an emergency event. If an emergency event is detected, the emergency event is reported. Determining whether the emergency signal represents an emergency event may include testing validity of the emergency signal to eliminate false positives. Reporting the emergency event may include sending an emergency event message to a remote server. The emergency event message may include time information and signal strength information associated with the detected emergency event and location information associated with the ground station.

19 Claims, 7 Drawing Sheets

EMERGENCY TRANSMISSION MONITORING AND REPORTING

BACKGROUND

Federal law requires emergency locator transmission (ELT) equipment on all aircraft traveling more than twenty-five miles from an airport and emergency position indicating radio beacons (EPIRBs) on certain classes of marine craft. ELTs are activated by gravitational forces (impact) while EPIRBs are activated by water contact. Both, however, may be manually activated.

ELT and EPIRB equipment transmit a distress waveform on particular emergency frequencies, e.g., 121.5 MHz and 243 MHz, to alert emergency frequency monitors that a distress incident has occurred. The distress waveform transmitted by these devices consists of an amplitude modulated carrier signal in which the modulating signal is an audio frequency sweeping downward over a range of not less than 700 Hz, within the range of 1,600 Hz to 300 Hz, and at a sweep rate varying between 2 Hz and 4 Hz. These characteristics are required by federal law, so that the transmitted distress waveform, which can be demodulated by a receiver to a siren-like sound, may easily be recognized by individuals monitoring on 121.5 MHz and 243 MHz, who can then alert search and rescue (SAR) personnel to search for the location of the source of the distress transmission and initiate rescue operations. The distress waveform, however, does not contain information other than that an ELT or an EPIRB is transmitting it. Accordingly, SAR personnel receive no advance information on whether they are searching for an airplane, marine vessel, camper, hiker, or skier. This uncertainty contributes to the inefficient use of SAR personnel and in poor coordination among rescue operations.

The United States Air Force together with the Civil Air Patrol (CAP) are responsible for SAR over land while the United States Coast Guard (USCG) handles SAR at sea. Monitoring of the emergency transmissions is done by satellite and ground stations. It may take three or four passes of a satellite to detect an emergency transmission. The three or four passes of the satellite translate to about three to four hours of delay before SAR activity can begin. In the case of distressed aircraft, the Air Force Rescue Coordination Center (AFRCC) receives notification from the satellite and then requests the CAP to launch CAP aircraft having on-board direction finder equipment. Typically, there may be one to four hours delay before the CAP aircraft launches and then an hour of flight time to get within the area of the emergency transmission. Subsequently, an airborne search begins. Once the search has been further narrowed, the SAR moves to a ground team to locate the accident site.

There may be false alarms detected due to faulty emergency transmission equipment or other non-emergency transmissions occurring on the emergency frequency bands. Depending on how quickly such false alarms can be discovered, the false alarms may result in a significant waste of already limited SAR resources.

SUMMARY

There is a need for improved emergency transmission monitoring and reporting to reduce the time delay in responding to an emergency transmission from aircraft or marine craft. There is also a need for an approach to monitoring and reporting that reduces the incidence of false alarms.

Accordingly, a method comprises monitoring an emergency frequency at a ground station for detection of an emergency signal and, upon detecting an emergency signal, determining whether the emergency signal represents an emergency event. If an emergency event is detected, the emergency event is reported.

Determining whether the emergency signal represents an emergency event may include testing validity of the emergency signal to eliminate false positives. Testing validity of the emergency signal may include declaring an emergency event if the emergency signal is continuously present during a time interval or during K time intervals, where K>1.

Reporting the emergency event may include sending an emergency event message to a remote server. The emergency event message may include time information and signal strength information associated with the detected emergency event and location information associated with the ground station.

According to another aspect, apparatus at a ground station comprises a processor configured to (i) monitor an emergency frequency for detection of an emergency signal, (ii) determine whether a detected emergency signal represents an emergency event and (iii) format an emergency event message; and a network interface coupled to the processor that communicates the emergency event message, e.g., to a remote server.

The apparatus may include a radio receiver coupled to the processor that receives emergency frequency transmissions, wherein the processor monitors the received emergency frequency transmissions.

According to another aspect, a system comprises plural monitor units located at respective ground stations and a server. Each unit may be configured to (i) monitor an emergency frequency for detection of an emergency signal, (ii) determine whether a detected emergency signal represents an emergency event, (iii) format an emergency event message and communicate the emergency event message over a network. The server may be coupled to the monitor units over the network, and may be configured to (i) receive the emergency event message communicated by any of the monitor units, (ii) determine a location of the emergency event, (iii) select an emergency services provider based on the location of the emergency event and (iv) report the emergency event to the selected emergency services provider.

With the present approach, an emergency event may be discovered faster than with satellite monitoring due to the ability to monitor transmissions more frequently. In addition, the location of the emergency event can be determined faster and more accurately since the location of the reporting monitor unit can be readily determined.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
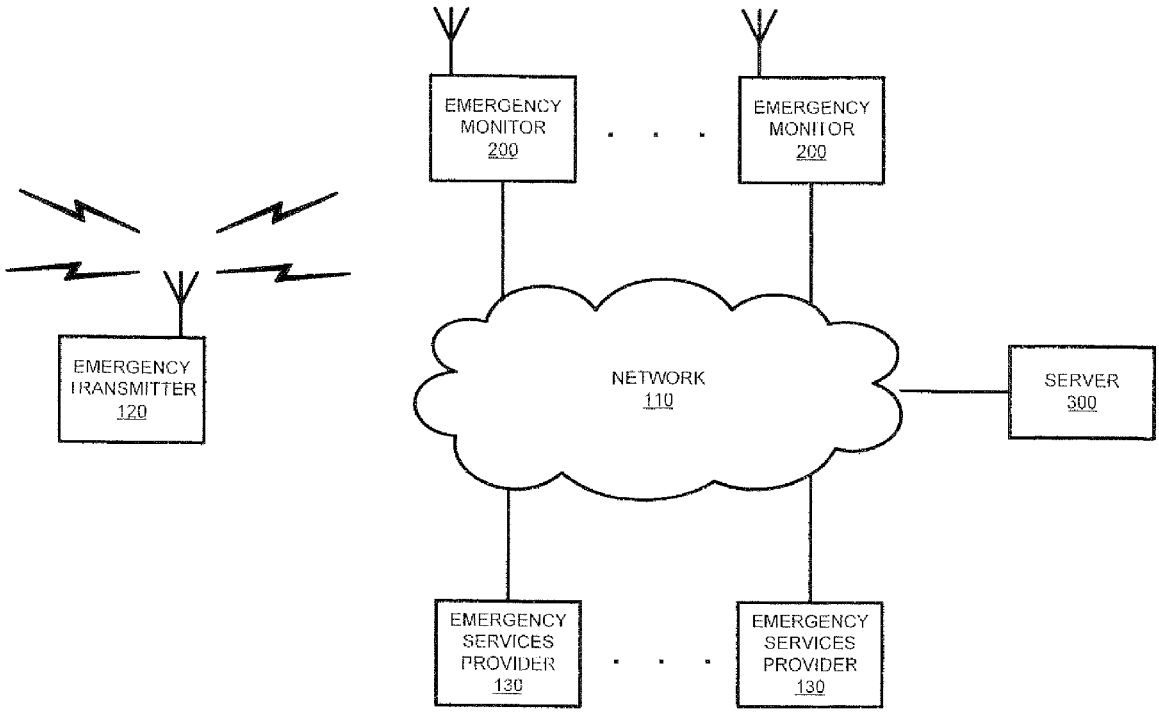
FIG. 1 illustrates an example emergency monitoring and reporting arrangement that may be used with the techniques described herein.

FIG. 1 illustrates an embodiment of an emergency monitoring and reporting configuration featuring elements that may be used with the techniques described herein. The configuration includes a plurality of emergency monitor units 200, a plurality of emergency services providers (ESPs) 130 and a server 300 interconnected over a communication network 110. The configuration further includes an emergency transmitter 120 which may be any ELT or EPIRB transmission equipment associated with aircraft or marine craft, respectively, that transmits a distress waveform on 121.5 MHz, 243 MHz or other designated emergency frequency to alert emergency frequency monitors that a distress incident has occurred. For simplicity, only one emergency transmitter 120 is shown, though it should be understood that any number of emergency transmitters 120 may be present at any number of locations in such a configuration. The ESPs 130 may be any entity that is designated to respond to emergencies relating to aircraft or marine craft, such as AFRCC, CAP, USCG or other designated public or private emergency response entities.

The emergency monitor units 200 may be positioned at ground stations. Generally, a ground station is a location that is equipped to receive, or receive and transmit, signals from or to aircraft or marine craft.

The server 300 is a conventional server configured to, infer alia, process messages (e.g., reports) issued by the emergency monitor units 200. The communication network 110 may be any network capable of providing a communication connection between an origin and destination. For example, the network 110 may comprise wireless, wireline, private or public network elements, a virtual private network within the Internet, a wide area network, local area network, Voice over Internet Protocol network, or the like, or any combination thereof. The network 110 may be implemented using any appropriate transmission, switching and routing technologies, including but not limited to Internet Protocol, Asynchronous Transfer Mode and Signaling System 7.

In operation, a particular emergency monitor unit 200 located within the vicinity of the emergency transmitter 120 is configured to monitor the emergency frequency or frequencies periodically. Upon detection of an emergency transmission from the emergency transmitter 120, the emergency monitor unit 200 determines whether the detected emergency transmission represents a valid emergency event. If the transmission is a valid emergency event, the emergency monitor unit 200 reports the event to the server 300. Subsequently, the server 300 reports the emergency to an appropriate ESP. Details of how the transmission is determined valid and the event reported are provided further herein.

Figure 2:
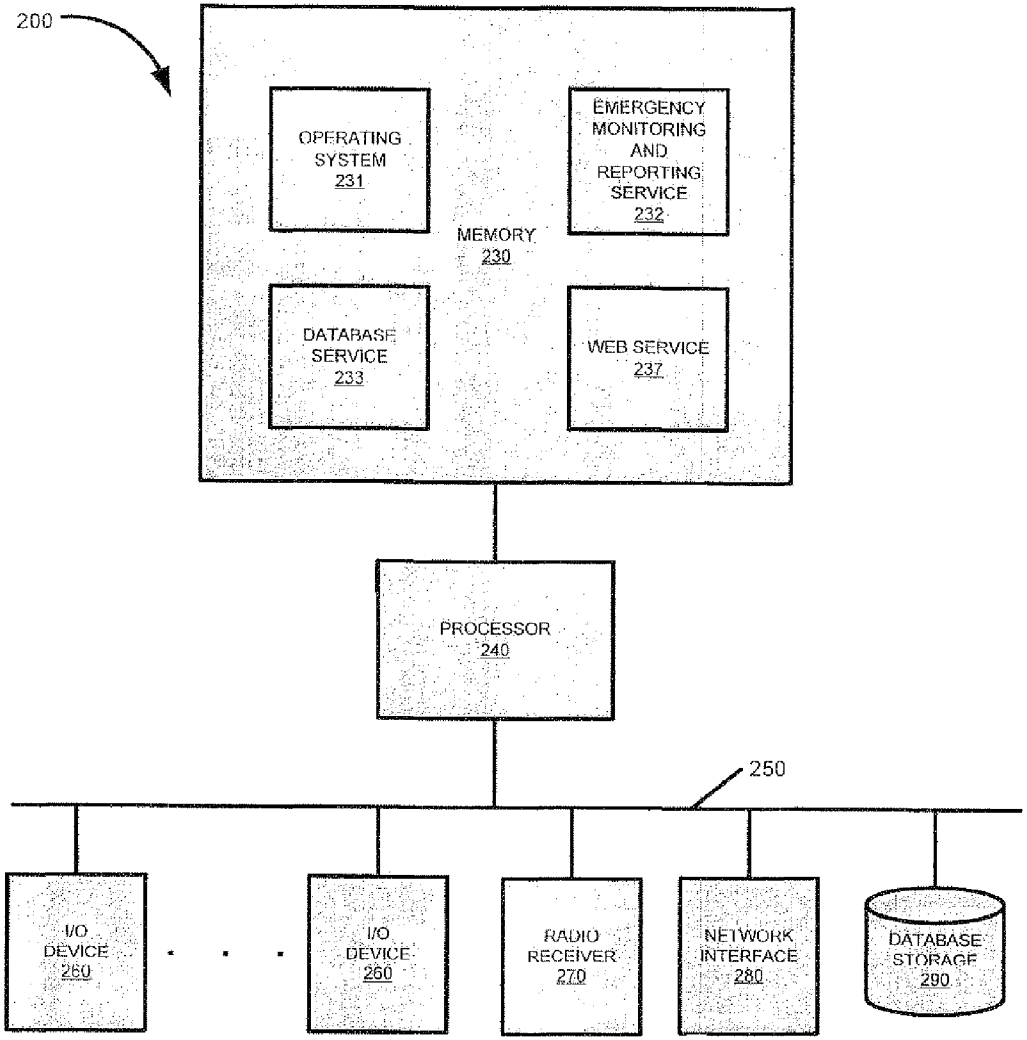
FIG. 2 illustrates an example emergency monitor unit that may be used with the techniques described herein.

FIG. 2 illustrates an example emergency monitor unit 200. The monitor unit 200 comprises a memory 230 and a processor 240 coupled over bus 250 to one or more I/O devices 260, a radio receiver 270, a network interface 280 and database storage 290. The processor 240 is a conventional CPU configured to execute instructions and manipulate data contained in memory 230. The I/O devices 260 are conventional I/O devices such as keyboards, storage units, display devices and the like. The radio receiver 270 is a conventional radio receiver that is configured to receive radio frequency transmissions in the emergency frequency bands of interest, e.g., 121.5 MHz and 243 MHz. The radio receiver 270 demodulates such received transmissions to a digital baseband signal in a conventional manner and makes the digital baseband signal available to the processor 240 on the bus 250. The network interface 280 is a conventional network interface that is configured to interface the monitor unit 200 with the network 110. To that end, the network interface 280 comprises conventional interface circuitry that incorporates signal, electrical characteristics and interchange circuits needed to interface with the physical media of the network and the protocols running over that media. For example, the network interface 280 may include satellite, telephone lines, Internet links, network links, wireless or other suitable communication channels. The database storage 290 is a conventional storage medium configured to hold a structured query language (SQL) database. As described further below, this database comprises, inter alia, a log of emergency events.

The memory 230 is a conventional random access memory (RAM) comprising, e.g., dynamic RAM devices. Memory 230 contains an operating system 231, emergency monitoring and reporting service 232, database service 233 and web service 237. The operating system 231 is a conventional operating system configured to schedule the execution of processes such as emergency monitoring and reporting service 232, database service 233 and web service 237 on processor 240 as well as provide controlled access to various resources associated with monitor unit 200, such as the I/O devices 260, radio receiver 270, network interface 280 and database storage 290.

The emergency monitoring and reporting service 232 comprises computer executable instructions configured to monitor emergency transmissions from an emergency transmitter 120, determine whether the transmissions represent an emergency event and report any emergency events across the network 110 to server 300 (FIG. 1). In addition, the emergency monitoring and reporting service 232 may direct the database services 233 to log emergency events in a database contained in database storage 290. The database service 233 comprises computer executable instructions that are configured to manage the logging of emergency events in the database on database storage 290. The web service 237 comprises computer executable instructions configured to implement a web server that enables an administrator to gain access to the events log contained in the database on database storage 290.

Figure 3:
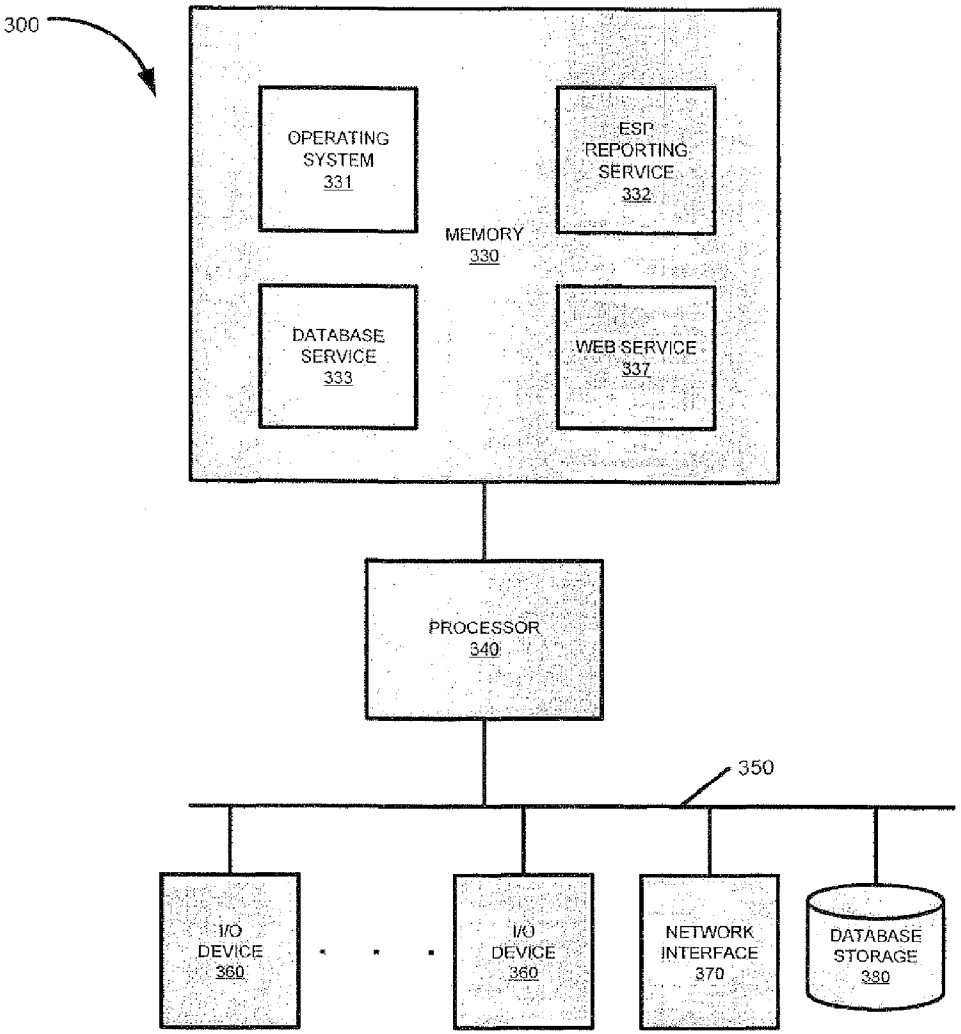
FIG. 3 illustrates an example server that may be used with the techniques described herein.

FIG. 3 illustrates an example server 300. Server 300 comprises a memory 330 and a processor 340 coupled to one or more I/O devices 360, a network interface 370 and database storage 380 over bus 350. The processor 340 is a conventional CPU configured to execute instructions and manipulate data contained in memory 330. The I/O devices 360 are conventional I/O devices such as keyboards, storage units, display devices and the like. The network interface 370 is a conventional network interface that is configured to interface the server 300 with the network 110. To that end, the network interface 370 comprises conventional interface circuitry that incorporates signal, electrical characteristics and interchange circuits needed to interface with the physical media of the network and the protocols running over that media. The database storage 380 is a conventional storage medium configured to hold a SQL database. As will be described further below, this database comprises, inter alia, emergency reports from the emergency monitor units 200.

The memory 330 is a conventional RAM comprising e.g., DRAM devices. Memory 330 contains an operating system 331, emergency services provider (ESP) reporting service 332, database service 333 and web service 337. The operating system 331 is a conventional operating system configured to schedule the execution of processes such as ESP reporting service 332, database service 333 and web service 337 on processor 340 as well as provide controlled access to various resources associated with server 300, such as the I/O devices 360, network interface 370 and database storage 380. An example of an operating system that may be used with the present invention is the Windows 2000 server operating system.

The ESP reporting service 332 comprises computer executable instructions configured to receive emergency event reports from the various emergency monitor units 200 and determine which ESPs are to receive the individual event reports. In addition, the ESP reporting service 332 may direct the database services 333 to store the received reports in a database contained in database storage 380. The database service 333 comprises computer executable instructions that are configured to manage the event reports in the database on database storage 380. The web service 337 comprises computer executable instructions configured to implement a web server that enables an administrator to gain access to event reports contained in the database on database storage 380.

Figure 4:
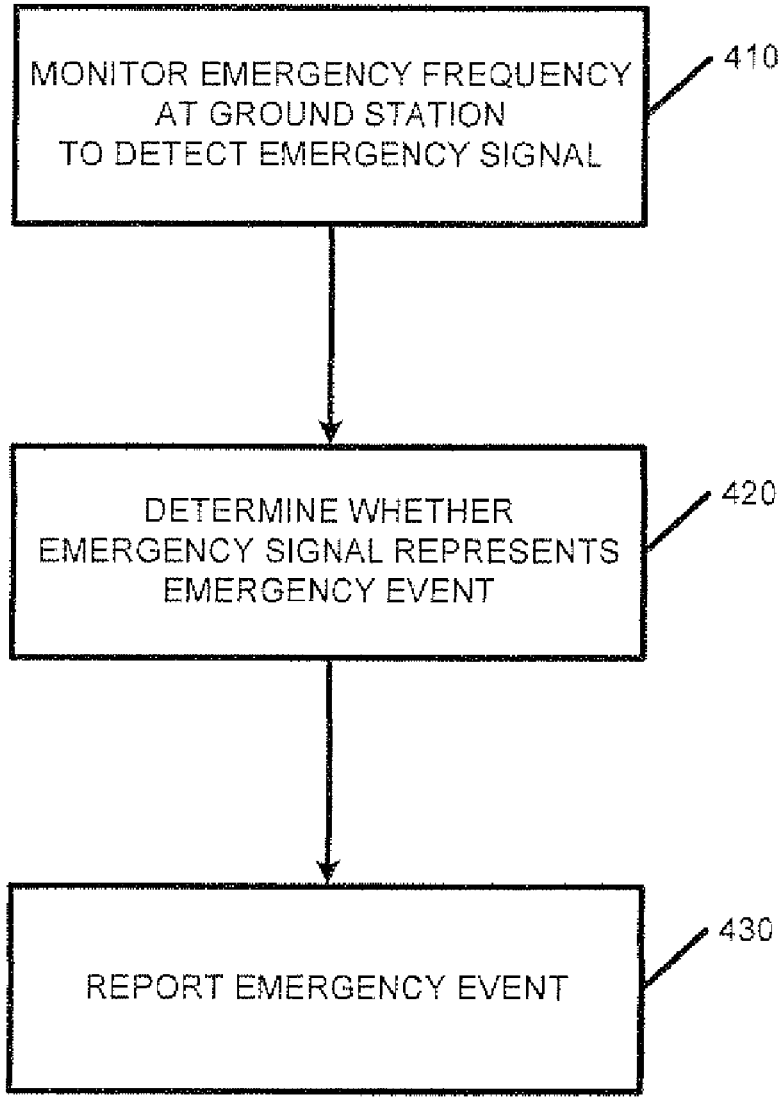
FIG. 4 illustrates an overview of process steps that may be used by the emergency monitor unit of FIG. 2.

FIG. 4 illustrates an overview of a sequence that may be used by the emergency monitor unit 200. At step 410, the monitor unit monitors emergency frequencies at a ground station to detect the presence of emergency transmissions. If transmissions are detected, at step 420 the monitor unit determines whether the transmissions represent an emergency event by subjecting the transmissions to a validity test described further herein. If the transmissions do represent an emergency, then at step 430 the monitor unit reports an emergency event to server 300 (FIG. 1).

Figure 5A:
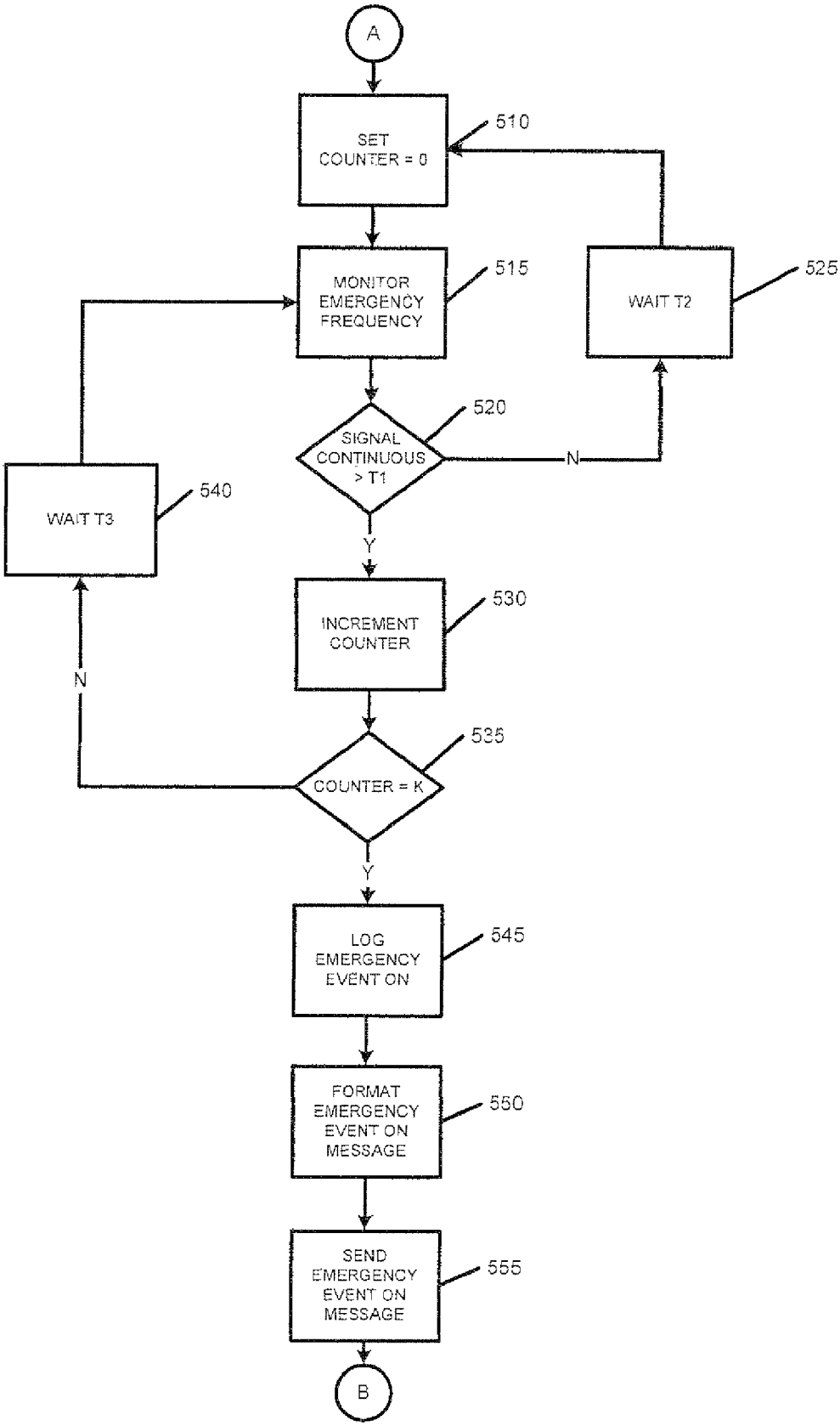
FIGS. 5A-5B illustrate a detailed flow chart of a sequence of steps that may be used by the emergency monitor unit of FIG. 2.
Figure 5B:
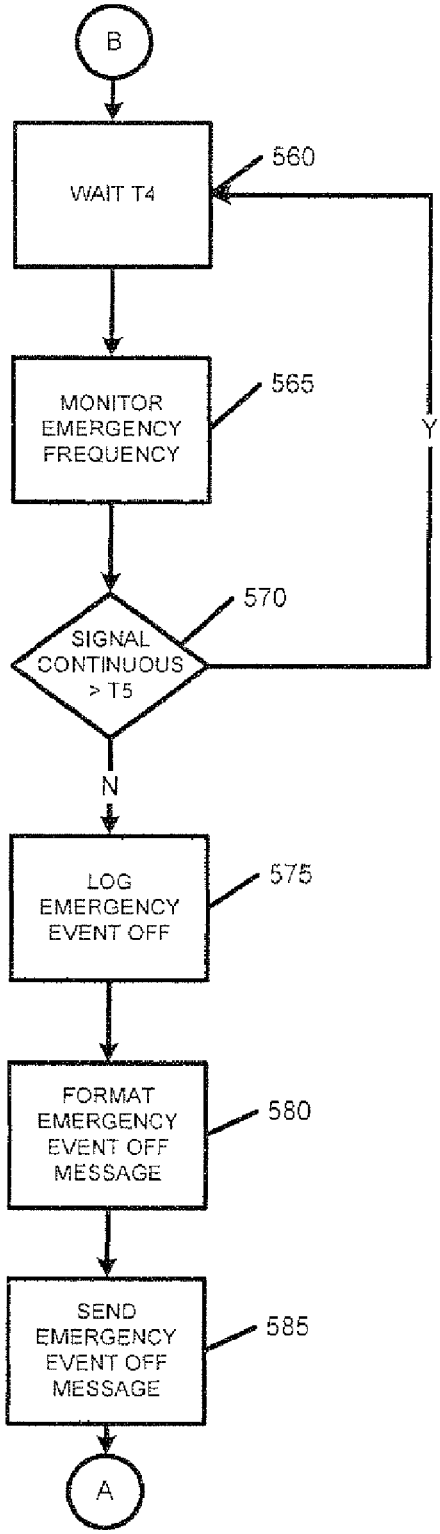

FIGS. 5A-5B illustrate a detailed flow chart of a sequence of steps that may be used by the emergency monitoring unit 200 (FIG. 2). This sequence is an example of the process steps associated with emergency monitoring and reporting service 232 (FIG. 2) executed by processor 240. Referring now to FIG. 5A, the process starts a monitoring loop at step 510 by setting a counter to zero. At step 515, the monitor unit monitors the emergency frequency or frequencies to determine if transmissions are present at radio receiver 270 (FIG. 2). If a emergency frequency signal is not present continuously for more than a time interval T1 (e.g., 3 seconds) at step 520, then after a wait interval T2 (e.g., 20 minutes) at step 525, the monitoring process loops back to begin again at step 510. Otherwise, processing continues at step 530 with the counter incremented to indicate that the detected transmission was continuous for the time interval T1.

At step 535, the counter value is checked to determine if the detected transmission has occurred K times (e.g., K=3). If the counter value is less than K, then after a wait interval T3 (e.g., 1 minute) at step 540, the monitoring process loops back to step 515 to determine if the transmission is still present for the required interval T1. Otherwise, processing continues at step 545 with declaration of an emergency event and logging of an EVENT ON to the database on database storage 290 (FIG. 2). The processor 240 (FIG. 2) formats an EVENT ON message at step 550 for sending to server 300 at step 555 through network interface 280 (FIG. 2).

The process seeks to eliminate false positives at two levels. At the first level, the emergency transmission signal is required to be continuously present for time interval T1. At the second level, the continuously present emergency transmission signal is required to be present K times.

The EVENT ON message may include time, signal strength and location information. For example, the time information may be a time stamp associated with the determination that the event has occurred. The signal strength information may be a representation of the strength of the emergency frequency signal received at radio receiver 270 (FIG. 2). The location information may include geographic coordinates or other location indicia associated with the particular monitor unit.

Referring now to FIG. 5B, having determined that an emergency event has occurred, the process continues with monitoring of the emergency transmission. In particular, another monitoring loop begins at step 560 with a wait interval T4 (e.g., 20 minutes) before monitoring of the emergency frequency at step 565. If a signal is present continuously for more than a time interval T5 (e.g., 3 seconds) at step 570, then the monitoring process loops back to begin again at step 560. Otherwise, processing continues at step 575 with declaration that the emergency transmission has ended and logging of an EVENT OFF to the database on database storage 290 (FIG. 2). The processor formats an EVENT OFF message at step 580 for sending to server 300 at step 585 through network interface 280. Processing may continue at the beginning monitoring loop at step 510 (FIG. 5A).

It should be understood that the time intervals and counter value K for the process shown in FIGS. 5A-5B may be selected based on a variety of considerations. For example, time intervals T2 and T4 may be set to zero in a monitor unit that is dedicated only to monitoring of emergency frequencies. In other embodiments, the features of the emergency monitor unit may be implemented in radio communications equipment that performs additional functions, such as an air-traffic advisory system or automatic weather observation system (AWOS) that monitor so-called common traffic advisory frequencies. An example system is the SUPERAWOS™ system available from Potomac Aviation Technology Corporation, Boston, Mass. In systems which monitor multiple frequencies for different purposes, it may be sufficient or practical to set the monitoring intervals T2 and T4 to 20 minutes.

Figure 6:
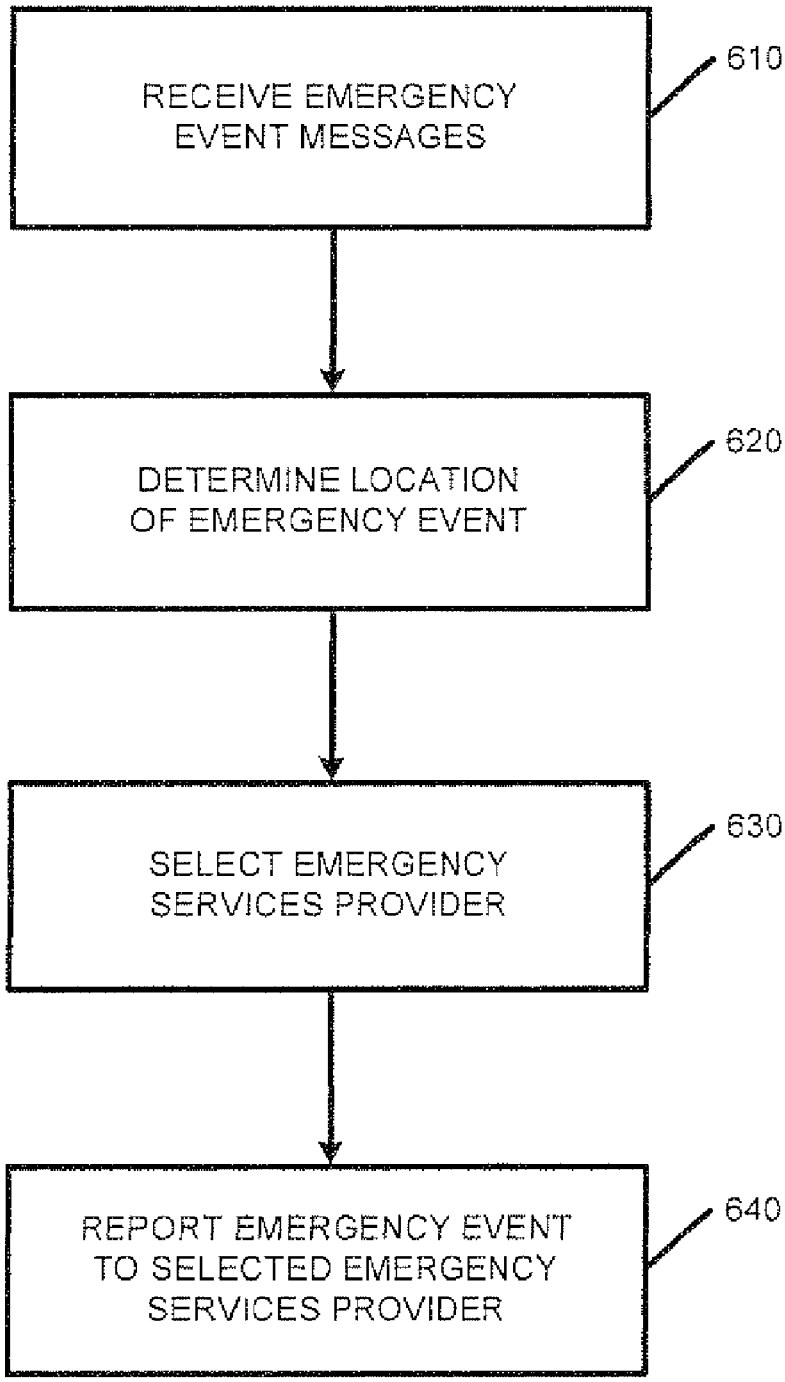
FIG. 6 illustrates a sequence of steps that may be used by the server of FIG. 3.

FIG. 6 illustrates a sequence of steps that may be used by the server 300 (FIG. 3). This sequence is an example of the process steps associated with ESP reporting service 332 executed by processor 340 (FIG. 3). At step 610, the server 300 receives an emergency event message (e.g., EVENT ON and EVENT OFF) through network interface 370 (FIG. 3). At step 620, the processor 340 may determine an approximate location of the emergency event based on location information contained in the event message. The process may also determine an estimated range for the distressed aircraft or marine craft based on the signal strength information. In cases where multiple monitor units at different locations in a given geographical area detect the emergency signal and report an emergency event, signal strength information from the respective locations may be used to triangulate a position of the emergency event. Using the estimated location and range of the emergency event, the process at step 630 selects an appropriate ESP. At step 640 a report of the emergency event is sent to the selected ESP for appropriate handling While this invention has been particularly shown and described with references to example embodiments thereof, it will be understood by those skilled in the art that various changes in form and details may be made therein without departing from the scope of the invention encompassed by the appended claims.

What is claimed is:

1. A computer implemented method comprising:

monitoring an emergency frequency at a ground station for detection of an emergency signal;

upon detecting an emergency signal, determining whether the emergency signal represents an emergency event by testing validity of the emergency signal wherein testing validity of the emergency signal includes declaring an emergency event if the emergency signal is continuously present during K time intervals, where K>1;

if an emergency event is detected, reporting the emergency event.

2. The method of claim 1 wherein monitoring the emergency frequency includes monitoring periodically.

3. The method of claim 1 wherein reporting the emergency event includes sending an emergency event message to a server.

4. The method of claim 3 wherein the emergency event message includes time information and signal strength information associated with the detected emergency event, the signal strength information representing strength of the emergency frequency signal.

5. The method of claim 4 wherein the emergency event message further includes location information associated with the ground station.

6. Apparatus at a ground station, the apparatus comprising:

a processor configured to (i) monitor an emergency frequency for detection of an emergency signal, (ii) determine whether a detected emergency signal represents an emergency event by testing validity of the emergency signal, the processor tests validity of the emergency signal by declaring an emergency event if the emergency signal is continuously present during K time intervals, where K>1 and (iii) format an emergency event message; and a network interface coupled to the processor that communicates the emergency event message.

7. The apparatus of claim 6 further comprising a radio receiver coupled to the processor that receives emergency frequency transmissions, wherein the processor monitors the received emergency frequency transmissions.

8. The apparatus of claim 6 wherein the processor is configured to monitor the emergency frequency periodically.

9. The apparatus of claim 6 wherein the network interface communicates the emergency event message to a server.

10. The apparatus of claim 6 wherein the emergency event message includes time information and signal strength information associated with the detected emergency event, the signal strength information representing strength of the emergency frequency signal.

11. The apparatus of claim 10 wherein the emergency event message further includes location information associated with the ground station.

12. A system comprising:

plural monitor units located at respective ground stations, each unit configured to (i) monitor an emergency frequency for detection of an emergency signal, (ii) determine whether a detected emergency signal represents an emergency event by testing validity of the emergency signal, the monitor unit tests validity of the emergency signal by declaring an emergency event if the emergency signal is continuously present during K time intervals, where K>1 (iii) format an emergency event message and communicate the emergency event message over a network; and a server coupled to the plural monitor units over the network, the server configured to (i) receive the emergency event message communicated by any of the monitor units, (ii) determine a location of the emergency event, (iii) select an emergency services provider based on the location of the emergency event and (iv) report the emergency event to the selected emergency services provider.

13. The system of claim 12 wherein the emergency event message includes time information and signal strength information associated with the detected emergency event and location information associated with the ground station, the signal strength information representing strength of the emergency frequency signal.

14. A computer implemented method comprising:

monitoring an emergency locator transmission (ELT) frequency band at a ground station having an emergency monitoring unit that includes a radio receiver configured to receive radio transmissions in the ELT band from aircraft;

declaring an emergency event associated with a distressed aircraft if radio transmissions received in the ELT band are present continuously during K time intervals, where K>1; and if the emergency event is declared, reporting the emergency event.

15. The method of claim 14 wherein reporting the emergency event includes sending an emergency event message to a server, the emergency event message including time information and signal strength information associated with the declared emergency event and location information associated with the ground station.

16. Apparatus at a ground station, the apparatus comprising:

a radio receiver configured to receive radio transmissions in an emergency locator transmission (ELT) frequency band from aircraft;

a processor configured to (i) declare an emergency event associated with a distressed aircraft if radio transmissions received in the ELT band are present continuously during K time intervals, where K>1 and (ii) format an emergency event message associated with the declared emergency event; and a network interface coupled to the processor that communicates the emergency event message.

17. The apparatus of claim 16 wherein the emergency event message includes time information and signal strength information associated with the declared emergency event and location information associated with the ground station.

18. A system comprising:

plural monitor units located at respective ground stations, each unit configured to (i) receive radio transmissions in an emergency locator transmission (ELT) frequency band from aircraft (ii) declare an emergency event associated with a distressed aircraft if radio transmissions received in the ELT band are present continuously during K time intervals, where K>1 and (iii) communicate an emergency event message associated with the declared emergency event over a network; and a server coupled to the plural monitor units over the network, the server configured to (i) receive the emergency event message communicated by any of the monitor units, (ii) determine a location of the emergency event, (iii) select an emergency services provider based on the location of the emergency event and (iv) report the emergency event to the selected emergency services provider.

19. The system of claim 18 wherein the emergency event message includes time information and signal strength information associated with the detected emergency event and location information associated with the ground station.

* * * * *